US005308004A

United States Patent [19]

Ukai et al.

[11] Patent Number: 5,308,004

[45] Date of Patent: May 3, 1994

[54] METHOD OF AUTOMATICALLY TRANSFERRING AN ELASTIC YARN FROM A FULL-BOBBIN TO AN EMPTY-BOBBIN

[75] Inventors: Norio Ukai; Takamitu Kawazoe, both of Nobeoka, Japan

[73] Assignee: Asahi Kasei Kogyo Kabushiki Kaisha, Japan

[21] Appl. No.: 86,109

[22] Filed: Apr. 27, 1993

Related U.S. Application Data

[63] Continuation of Ser. No. 944,714, Sep. 11, 1992, abandoned, which is a continuation of Ser. No. 817,992, Jan. 9, 1992, abandoned, which is a continuation of Ser. No. 688,383, Apr. 22, 1991, abandoned, which is a continuation of Ser. No. 586,393, Sep. 20, 1990, abandoned, which is a continuation of Ser. No. 401,003, Aug. 31, 1989, abandoned.

[30] Foreign Application Priority Data

Sep. 6, 1988 [JP] Japan ..... 63-223288
Jun. 1, 1989 [JP] Japan ..... 1-139453

[51] Int. Cl.[5] ..... B65H 67/048
[52] U.S. Cl. ..... 242/18 A
[58] Field of Search ..... 242/18 A, 25 A

[56] References Cited

U.S. PATENT DOCUMENTS

| | | | |
|---|---|---|---|
| 2,905,402 | 9/1959 | Foller et al. | 242/18 A |
| 3,841,574 | 10/1974 | Lenk et al. | 242/18 A X |
| 3,921,923 | 11/1975 | Kuno et al. | 242/18 A |
| 4,033,519 | 7/1977 | Abe et al. | 242/18 A |
| 4,106,710 | 8/1978 | Schippers et al. | 242/18 A X |
| 4,298,171 | 11/1981 | Fluckiger et al. | 242/18 A |
| 4,431,138 | 2/1984 | Schiminski et al. | 242/18 A |
| 4,552,313 | 11/1985 | Sasaki | 242/18 A |

FOREIGN PATENT DOCUMENTS

| | | | |
|---|---|---|---|
| 824523 | 10/1969 | Canada | 242/18 A |
| 2246764 | 4/1973 | Fed. Rep. of Germany . | |
| 2914440 | 10/1979 | Fed. Rep. of Germany . | |
| 3339406 | 5/1985 | Fed. Rep. of Germany . | |
| 3831341 | 4/1989 | Fed. Rep. of Germany . | |

*Primary Examiner*—Stanley N. Gilreath
*Attorney, Agent, or Firm*—Finnegan, Henderson, Farabow, Garrett & Dunner

[57] ABSTRACT

A method of automatically transferring an elastic yarn from a full-bobbin to an empty-bobbin characterized in that the yarn transfer operation is performed in a state such that a friction roll is remote from the empty-bobbin around which a yarn to be transferred is wound, and the yarn to be transferred is wound on the empty-bobbin by stopping the full-bobbin.

5 Claims, 8 Drawing Sheets

METHOD OF AUTOMATICALLY TRANSFERRING AN ELASTIC YARN FROM A FULL-BOBBIN TO AN EMPTY-BOBBIN

This application is a continuation of U.S. patent application Ser. No. 07/944,714, filed Sept. 11, 1992; which is a continuation of U.S. patent application Ser. No. 07/817,992, filed Jan. 9, 1992; which is a continuation of U.S. patent application Ser. No. 07/688,383, filed Apr. 22, 1991; which is a continuation of U.S. patent application Ser. No. 07/586,393, filed Sept. 20, 1990; which is a continuation of U.S. patent application Ser. No. 07/401,003, filed Aug. 31, 1989, all of which are now abandoned.

BACKGROUND OF THE INVENTION

1. Field of the Invention

The present invention relates to a method of automatically transferring an elastic yarn from a full-bobbin on a bobbin shaft to an empty-bobbin on another bobbin shaft in a winder which is continuously winding the elastic yarn, to improve the efficiency of an automatic transfer operation of the elastic yarn.

2. Description of the Related Art

An elastic yarn has specific characteristics i.e., a high stretchability, a high frictional property or the like, compared with a general-purpose synthetic fiber such as a polyamide fiber or a polyester fiber, and accordingly, the following specific yarn transfer methods have been applied for the transfer of an elastic yarn.

Japanese Unexamined Patent Publication (Kokai) No. 47-27634 disclosed a method of transferring a yarn wound continuously on a full-bobbin to an empty-bobbin wherein the full-bobbin driven by a friction roll is moved away from the friction roll, the empty-bobbin is placed in contact with the friction roll, to rotate the empty-bobbin and the full-bobbin stopped until the empty-bobbin is rotated at a desired rotational speed, so that the yarn is automatically wound on the empty-bobbin, i.e., the yarn slack between the empty-bobbin and the full-bobbin is wound on the full-bobbin and the slack yarn is stretched between the empty-bobbin and the full-bobbin and is broken.

Since, however the elastic yarn has a high stretchability, when the elastic yarn is broken by a stretching operation the elastic yarn slides on a circumferential surface of the bobbin during the recovery of an original length of the elastic yarn.

Accordingly, since the elastic yarn partially strikes the circumferential surface of the bobbin and a tension in portions of the elastic yarn striking the circumferential surface of the bobbin suddenly becomes zero, the elastic yarn is flexed, i.e., portions of the elastic yarn move away from the circumferential surface and other portions of the elastic yarn adhere to the circumferential surface.

Usually, the portions of the elastic yarn moved away from the circumferential surface are eventually adhered to the circumferential surface, and the elastic yarn then continuously wound on the empty-bobbin. Nevertheless, a high speed spinning method in which a rotational surface speed of the friction roll and the bobbin is remarkably increased has been introduced, and an elastic yarn having a finer denier than a conventional elastic yarn is used. In these cases, often the elastic yarn is not wound on the empty-bobbin but on the friction roller, and thus the automatic yarn transfer operation was not carried out.

It appears that the above failure of the automatic yarn transfer operation is caused by the separation of a portion of the elastic yarn from the empty-bobbin in contact with the friction roll, and a length per weight of the elastic yarn in contact with the friction roller becomes long when the high speed spinning system and/or the finer elastic yarn is used, and thus the elastic yarn is wound on the friction roll.

Further, since a running pathway of the elastic yarn released from a traverse device is not restricted in the method of Japanese Unexamined Patent (Kokai) No. 47-27634, the elastic yarn is always stretched in a direction parallel to an axis of the empty-bobbin on the circumferential surface of the empty-bobbin. Therefore, this condition may contribute to the failure of the automatic yarn transfer operation.

Japanese Examined Patent Publication (Kokoku) No. 1-22195 disclosed another method of automatically transferring an elastic yarn from a full-bobbins to an empty-bobbin. A winder implementing the transfer method disclosed in Japanese Examined Patent Publication (Kokoku) No. 1-22195 is schematically illustrated in FIG. 11(A) and FIG. 11(B). As shown in FIG. 11(A), this winder is composed of two bobbin shafts 5 and 6, a turret dish 4 rotatably supporting the bobbin shafts 5 and 6 at positions spaced apart by an angle of 180°, a friction roll 1 able to come into contact with a bobbin 8 mounted on one of the two bobbin shafts 5 and 6 and driving the bobbin 8, and a traverse device 3. The winder is further provided with a yarn position restricting plate 7 arranged upstream of the traverse device 3 and having yarn guiding portions constituted by two inclined surfaces forming a yarn holding point at an end where the two inclined surfaces come together, and a yarn receiving opening formed between the other ends of the two inclined surfaces. When the elastic yarn is transferred from the full-bobbin to the empty-bobbin, the elastic yarn is released from the traverse device by turnings the yarn position restricting plate 7, and the positions of the full bobbin 8*a* and the empty-bobbin 8 are reversed by rotating the turret disk 4 through 180° (see FIG. 11(A)) so that the empty-bobbin comes into contact with the friction roll 1, and thus the elastic yarn is held in a slit arranged in the circumferential direction of the bobbin 8 on a circumferential surface of the bobbin 8 and is cut.

Since the empty-bobbin comes into contact with the friction roll when the elastic yarn is transferred from the full-bobbin to the empty-bobbin, in the method disclosed in Japanese Examined Patent Publication (Kokoku) No. 1-22195, this method has a draw back in that the same failure of the yarn transfer process as of Japanese Unexamined patent publication (Kokai) No. 47-27634 is likely to occur.

SUMMARY OF THE INVENTION

An object of the present invention is to provide a method of automatically transferring an elastic yarn, wherein the efficiency of a yarn transfer operation is improved by ensuring that the elastic yarn is not attached to and wound on a friction roll but is taken up by an empty-bobbin when the elastic yarn is transferred from a full-bobbin to the empty-bobbin in a winder having a friction roller.

Another object of the present invention is to provide an automatic elastic yarn transferring method which can be applied to a normal bobbin not provided with a special yarn holding means e.g., a slit.

The object of the present invention is achieved by a method of automatically transferring an elastic yarn from a full-bobbin on a bobbin shaft to an empty-bobbin on another bobbin shaft in a friction-driven type winder comprising a bobbin carrier supporting two bobbin shafts in different positions, a friction roller able to come into contact with a bobbin on which the elastic yarn is to be wound and a traverse device, in which the positions of the shafts can be reversed, characterized in that the empty-bobbin is rotated about an axis thereof in a state such that the empty-bobbin is moved and held in a position remote from the friction roll and is in contact with the elastic yarn extended from the full-bobbin, the elastic yarn is broken by stopping a feed of the elastic yarn to the full-bobbin, a broken end of the elastic yarn is wound on the empty-bobbin, and the portion wound on the empty-bobbin of the elastic yarn is firmly fixed on a surface of the empty-bobbin due to a specific characteristics of the elastic yarn, and then the friction roller and the empty-bobbin are brought into contact with each other.

Preferably, the bobbin carrier is a turret type bobbin carrier, and a space is provided between the empty-bobbin and the friction roller so that the empty-bobbin comes into contact with the elastic yarn extended from the full-bobbin, but does not come into contact with the friction roller, and the empty-bobbin is rotated.

Also preferably, the elastic yarn is drawn and broken between the full-bobbin and the empty-bobbin by stopping a rotation of the full-bobbin and winding a slack portion of the elastic yarn between the full-bobbin and the empty-bobbin onto the empty-bobbin.

The elastic yarn may be transferred from the full-bobbin to the empty-bobbin after the elastic yarn extended from the full-bobbin is removed from the traverse device.

A yarn guide having a concave shape and an opening having a length which is larger than a traversing width of the traverse device may be driven in a manner such that the elastic yarn is removed from the traverse device.

After the friction roller and the empty-bobbin come into contact with each other, preferably the empty-bobbin is rotated such that the elastic yarn is wound for between 50 to 1000 turns on the empty-bobbin, to firmly hold the elastic yarn on the empty-bobbin.

In the specification of the present application, the term "full-bobbin" is used to denote a yarn package formed by winding the elastic yarn on an empty-bobbin, and a quantity of yarn wound on the empty-bobbin is not limited to a specific value. Also, the term "empty-bobbin" is used to denote a bobbin per se or a bobbin with an elastic yarn wound on the bobbin and having a relatively short length necessary for performing an automatic yarn transfer operation.

As the method of moving and holding the empty-bobbin in a position remote from the friction roll, various method can be used, e.g., a method of moving the empty-bobbin toward and against the friction roll in a fixed position, a method of moving the friction roll toward and against the empty-bobbin in a fixed position, or a method of relatively moving both the friction roll and the empty-bobbin.

In the friction-type winder used in the present application, an empty-bobbin mounted on a bobbin shaft which can be freely rotated, but usually is not driven, is rotated by bringing the empty-bobbin into contact with a friction roll driven by a friction force due to the contact between the friction roll and the empty-bobbin.

An elastic yarn used in the present invention may be an elastic yarn made from any one of a polyurethane group polymer, a polyester group polymer, a polyamide group polymer, a polycarbonate group polymer or the like; a composite elastic yarn or a blended elastic yarn from the above elastic yarn; or an elastic yarn composed of the above polymer as a main ingredient and other polymers. Especially, the polyurethane elastic yarn having a soft segment which is a polyether, a polyester, a polyamide, a polycarbonate, a polycaprolactam, a polyetherester, or a mixture thereof, is preferably used.

DESCRIPTION OF THE PREFERRED EMBODIMENTS

To facilitate understanding of the present invention, the principle of the method of automatically transferring an elastic yarn from a full-bobbin to an empty-bobbin in accordance with the present invention is described in detail with reference to the attached drawings.

Figure 1:
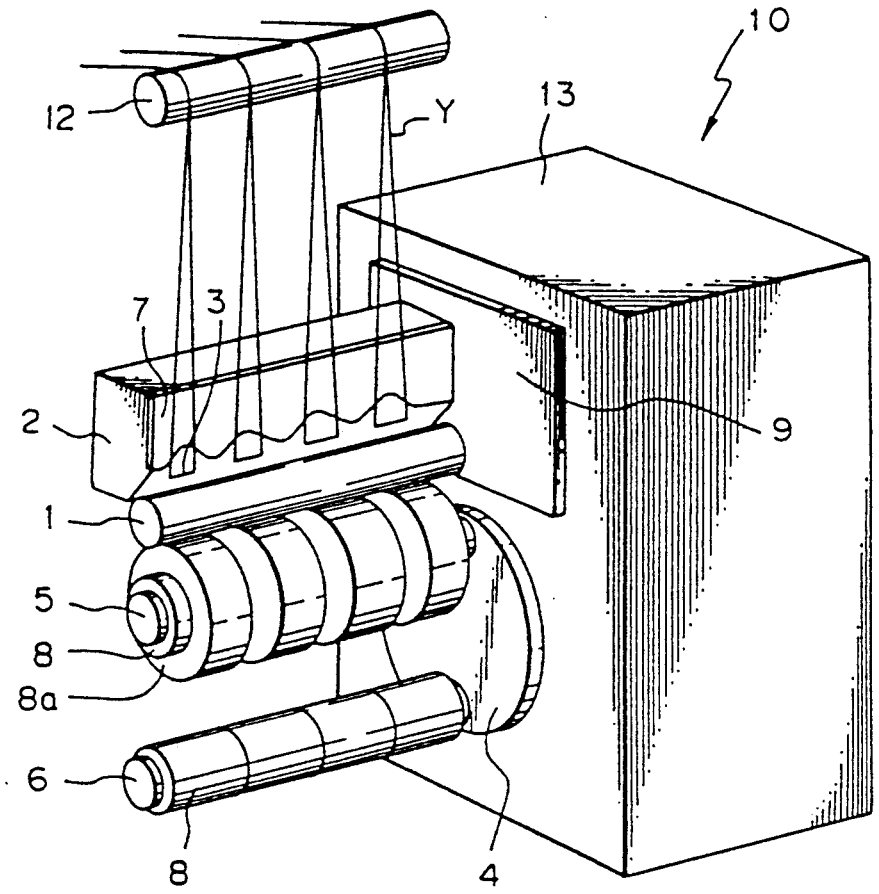
FIG. 1 is a perspective view illustrating an example of a turret type winder used for implementing an elastic yarn transfer method in accordance with the present invention.

FIG. 1 shows an example of a turret type winder used for implementing an elastic yarn transfer method in accordance with the present invention. The winder illustrated in FIG. 1 is composed of tow bobbin shafts 5 and 6, a turret dish 4 rotatably supporting the bobbin shafts 5 and 6 in positions spaced on a circle having a predetermined diameter and the same center as that of the dish 4, by 180° from each other, a friction roll 1 able to come into contact with a bobbin 8 mounted on one of the two bobbin shafts 5 and 6 and driving the bobbin 8, and a traverse device 3.

Figure 3:
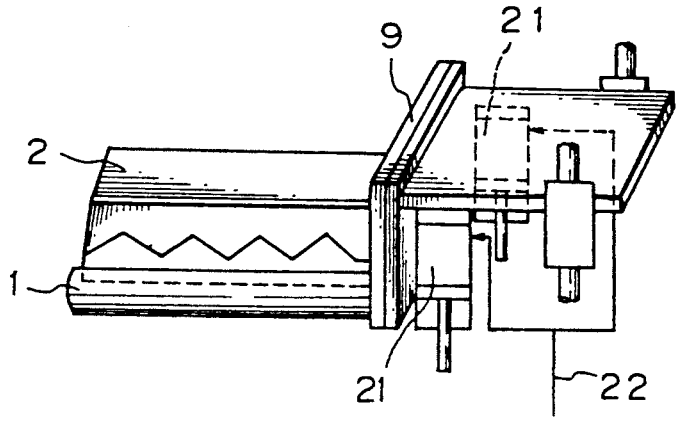
FIG. 3 is a perspective view illustrating a raising and descending device of a traverse device and a friction roll in the winder illustrated in FIG. 1.

Each end of a traverse box 2 in which the traverse device 3 is included, and the friction roll 1, are supported by a raising and descending plate 9. As illustrated in FIG. 3, the raising and descending plate 9 can be moved in a vertical plane by an air-operated twin-piston device 21 to which compressed air is supplied through a pipe 22 and included in a housing 13 of the winder. When compressed air is not supplied to the piston device 21, the traverse box 2 and the friction roll 1 are allowed to descend to a position at which the friction roll is in contact with a full-bobbin 8*a* mounted on the bobbin shaft 5, under its own weight, and is raised in accordance with an increase of a diameter of the full-bobbin 8*a*.

Figure 4:
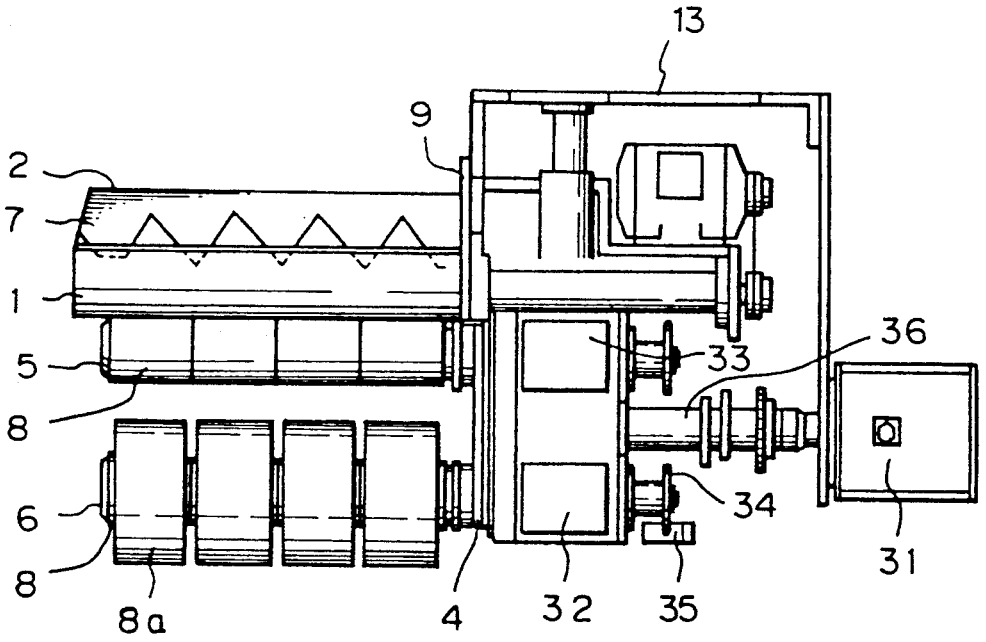
FIG. 4 is a partial cross sectional front view illustrating a turret dish rotating device, a device for rotating a full-bobbin and a device for rotating an empty-bobbin, in the winder illustrated in FIG. 1, respectively.
Figure 5:
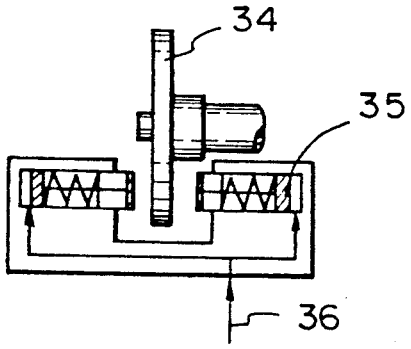
FIG. 5 is a cross sectional view illustrating a mechanism for stopping a rotation of the full-bobbin in the winder illustrated in FIG. 1.

As illustrated in detail in FIG. 4, the turret dish 4 can be rotated by a shaft 36 driven by a motor 31, to reverse the positions of the full-bobbin 8*a* and the empty-bobbin 8 when an exchange of the full-bobbin 8*a* and the empty-bobbin 8 and a yarn transfer operation are effected Each bobbin shaft also can be independently rotated by activating exclusive motors 32, 33, respectively. As described in detail hereafter, the full-bobbin 8*a* must be suddenly stopped when the yarn transfer operation is performed in accordance with the present invention. The above stopping of the full-bobbin 8*a* is effected by braking a dish 34 provided on a shaft of the motor 32, from both sides thereof, by using air-operated twin-piston devices 35 to which compressed air is supplied through a pipe 36, as illustrated in FIGS. 4 and 5.

Figure 6:
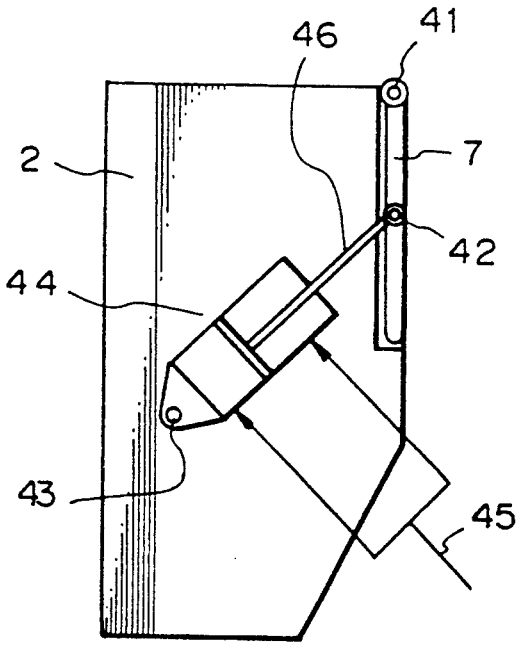
FIG. 6 is a front view illustrating an actuating mechanism of a yarn position restricting device in the winder illustrated in FIG. 1.

As described is detail hereafter, the yarn must be released from the traverse device 3 when the yarn transfer operation is performed in accordance with the present invention. Therefore a yarn position restricting plate 7 is pivotably attached to a front top corner of the traverse box 2 as illustrated in FIG. 1. More particularly, as illustrated in FIG. 6, a top end of the yarn position restricting plate 7 is pivotably supported by a pin 41 arranged on the front top corner of the traverse box 2, and another pin 42 is arranged near to a central position in a vertical direction in FIG. 6 of the yarn position restricting plate 7. An end of a piston rod 46 of a piston device 44 is pivotably attached to the pin 42, and a lower end of the piston device 44 is pivotably supported on a pin 43 fixed to the traverse box 2. Therefore, the yarn position restricting plate 7 can be swung about the pin 41 by supplying compressed air through a pipe 45 to the piston device 44.

Figure 2:
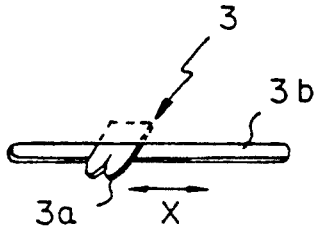
FIG. 2 is a perspective view illustrating in detail a traverse device of the winder illustrated in FIG. 1.
Figure 10:
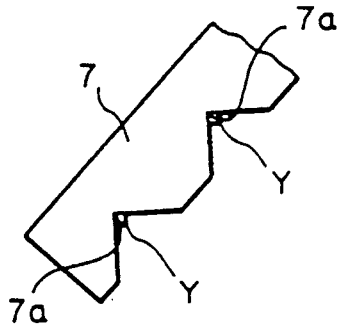
FIG. 10 is a plan view illustrating a shape of a yarn position restricting device in the winder illustrated in FIG. 1.
Figure 11A:
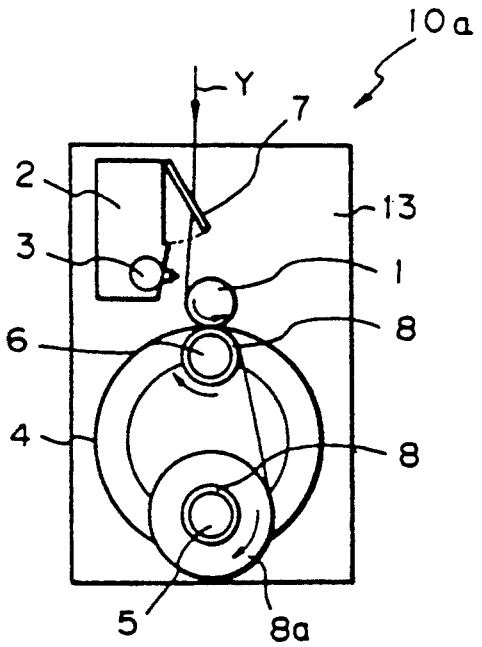
Fig. 11(A) PRIOR ART
FIG. 11(A) and 11(B) are front view illustrating two steps in a conventional elastic yarn transfer method.
Figure 11B:
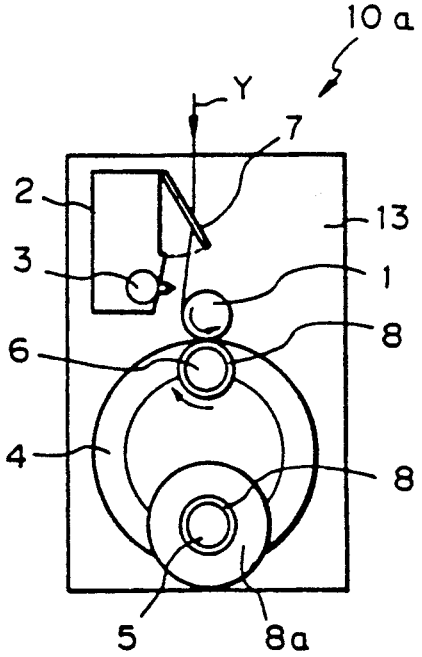
Fig. 11(B) PRIOR ART

As illustrated in detail in FIG. 10, an end opposite to the top end of the yarn position restricting plate 7 is provided with several saw-tooth-like depressions having deepest points thereof shown as 7*a* in FIG. 10. A length of an opening of the depression may be determined to be larger than a traverse length of the yarn caused by a traverse motion of the traverse device, and a yarn guide 3*a* can run in a horizontal direction in an elongated slit 3*b* and is provided with a notch opening at forward end thereof, as illustrated in FIG. 2. When the yarn position restricting plate 7 is moved from a vertical position as illustrated in FIG. 1 to a horizontal position, as illustrated, for example, in FIG. 7(F) by operating the piston device 44, the yarn held in the yarn guide 3*a* running in the horizontal direction can be easily released from the yarn guide 3*a*. Therefore, since the yarn can be withdrawn at a constant position of the empty-bobbin 8 by the empty bobbin 8 without a traverse motion, as described in detail hereafter, when the yarn transfer operation is performed, the elastic yarn attached to the empty-bobbin 8 is firmly held on the empty-bobbin 8.

An example of an elastic yarn automatic transfer method will now be described with reference to FIG. 7(A) to FIG. 7(G).

Figure 7A:
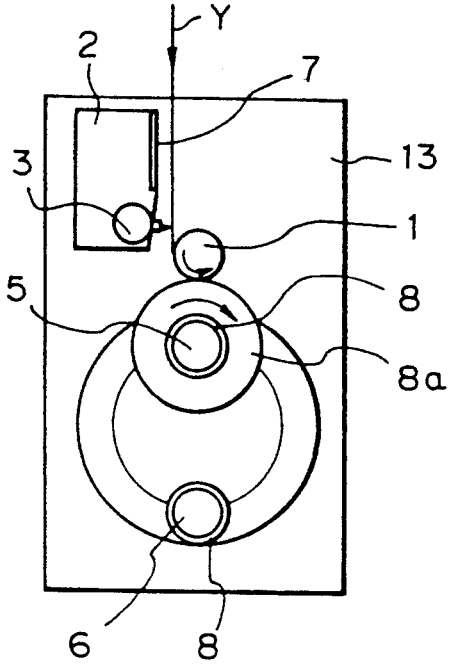
FIG. 7(A) to FIG. 7(G) are front views illustrating sequential steps in an example of the elastic yarn transfer method in accordance with the present invention, respectively.

FIG. 7(A) shows a state in which an elastic yarn having a predetermined length or a predetermined weight is wound on a full-bobbin 8*a* rotated by a friction roll 1, and reaches a stage at which it must be exchanged for an empty-bobbin 8.

Figure 7B:
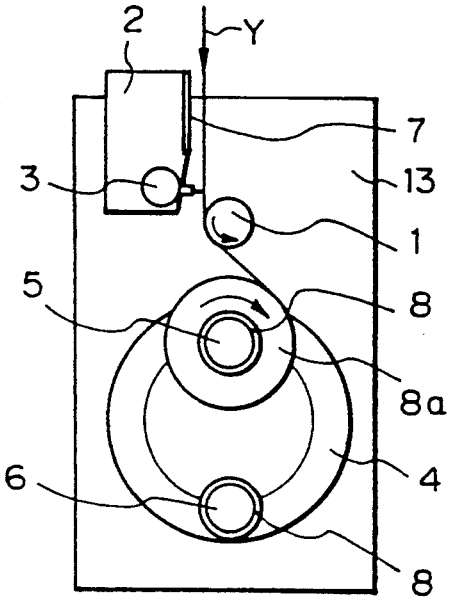
Figure 7C:
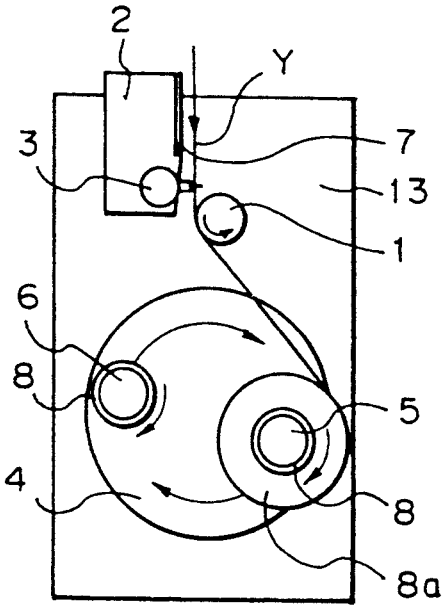
Figure 7D:
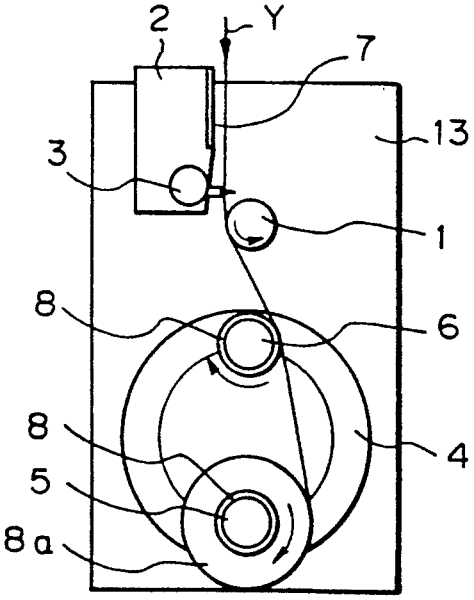
Figure 7E:
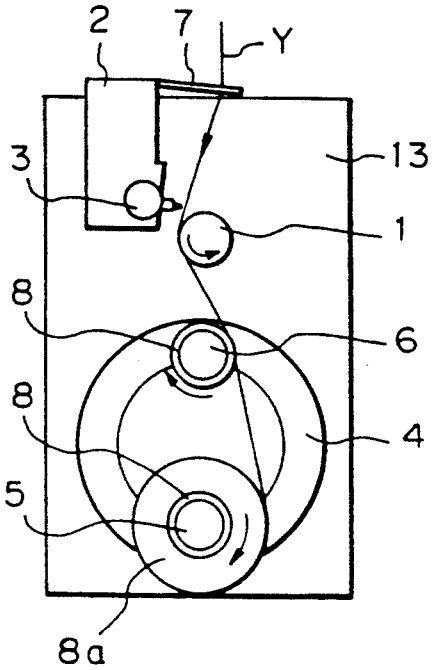
Figure 7F:
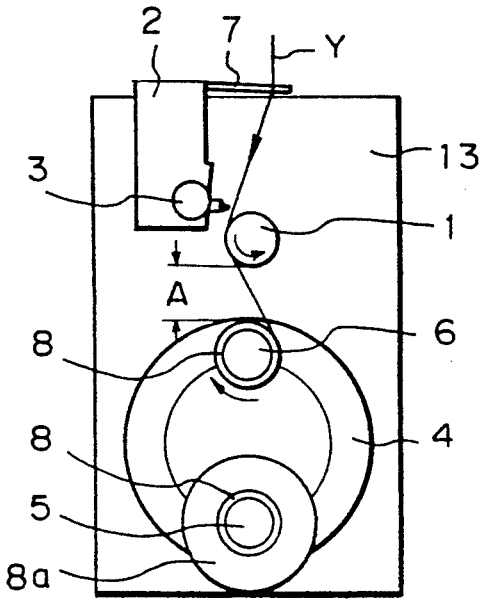

In the example illustrated in FIG. 7(A) to FIG. 7(G), when the elastic yarn automatic transfer operation is performed, first a friction roll 1 and a traverse box 2 are raised by operating the piston device 21 to separate the friction roll 1 from the full-bobbin 8*a*, as shown in FIG. 7(B). In FIG. 7(C), the empty bobbin 8 has already commenced its rotating movement as shown by the arrow. Next a turret disk 4 is rotated in a clockwise direction by 180° to reverse the positions of the full-bobbin 8*a* and the empty-bobbin 8 as shown in FIG. 7(C) and FIG. 7(D), and an elastic yarn Y extended from the full bobbin 8*a* comes into contact with the empty-bobbin 8. After or simultaneously with this operation, the elastic yarn Y is released from a traverse device 3 by raising a yarn position restricting plate about a pin 41 on a corner of a traverse box 2. Therefore the elastic yarn can be brought into contact with a defined position of a surface of the empty-bobbin 8, as shown in FIG. 7(E). After this operation, the full-bobbin 8*a* is suddenly stopped, so that the slack portion between the full-bobbin 8*a* and the empty-bobbin 8 of the elastic yarn Y is wound on the empty-bobbin 8 and the portion of the yarn is broken by being stretched between the full-bobbin 8*a* and the empty-bobbin 8. Since the elastic yarn has high coefficient of friction and stretchability, the slack portion of the elastic yarn recovers an original length thereof, and this portion of the elastic yarn can be easily wound on the empty-bobbin 8 due to the high frictional property thereof. In this state, since the friction roll 1 has already, moved from the position remote from the empty-bobbin 8, the portion of the elastic yarn cannot be wound on the friction roll 1, as in a yarn transfer operation in a conventional winder, and the portion of the elastic yarn can be firmly wound on the empty-bobbin 3 without hindering the yarn transfer operation from the full-bobbin 8*a* to the empty-bobbin 8.

Figure 7G:
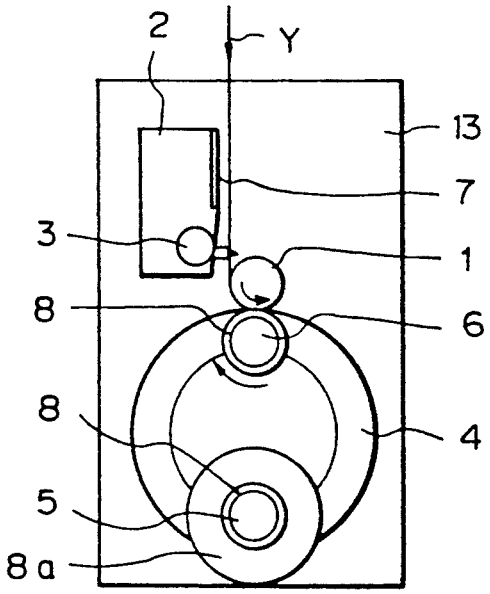

After the elastic yarn Y is transferred to the empty-bobbin 8, the elastic yarn Y is caught by a traverse, guide 3*a* of the traverse device 3 when the yarn position restricting plate is returned to an original position, and the traverse box 2 and the friction roll 1 descend in such a way that the friction roll is brought into contact with the empty-bobbin 3 on which is wound the elastic yarn Y, and thus a normal winding operation of the elastic yarn Y is started with a traverse motion, as shown in FIG. 7(G). The return of the yarn position restricting plate and the descent of the traverse box 2 and the friction roll 1 may be performed simultaneously or sequentially.

As described herebefore, the friction roll 1 must be kept separate from the empty-bobbin 8, when the yarn transfer operation is started. Namely, a distance A between a surface of the friction roll 1 and a surface of the empty-bobbin 8 (see FIG. 7(F)) is preferably 10 mm or more, more preferably 20 mm or more. If the distance A is 5 mm or less, the length of a portion of the elastic yarn in contact with the friction roll 1 becomes relatively long, and the elastic yarn is likely to be wound on the friction roll 1. Therefore, a space of at least 10 mm must be provided between the surface of the friction roll 1 and the surface of the empty-bobbin 8.

When the full-bobbin 8*a* to be stopped, the full-bobbin 8*a* need not be completely stopped but only a surface speed of the full-bobbin 8*a* need be decreased compared with a surface speed of the empty-bobbin 8 to slacken the portion of the elastic yarn Y extended between the full-bobbin 8*a* and the empty-bobbin 8. Nevertheless, to reduce a variation of the breakage of the elastic yarn Y and transfer the elastic yarn from the full-bobbin 8*a* to the empty-bobbin 8 without problems, preferably a means capable of fully stopping the rotation of the full-bobbin within several seconds is provided. Therefore, preferably a braking mechanism as shown in FIGS. 4 and 5 is used.

When the elastic yarn Y is wound on the empty-bobbin, preferably the elastic yarn Y is wound for 3 to 5 turns or more, more preferably 10 to 20 turns or more on the empty-bobbin 8 without a traverse motion. If the number of turns of the elastic yarn is less than 3 to 5, the elastic yarn may slip on the empty-bobbin or the broken end of the elastic yarn may project from a winding layer of the elastic yarn on the empty-bobbin, and the portion of the elastic yarn wound on the empty-bobbin 8 may be transferred from the empty-bobbin 8 to the friction roll 1 when the friction roll 1 comes into contact with the empty-bobbin 8 in this state.

Figure 8A:
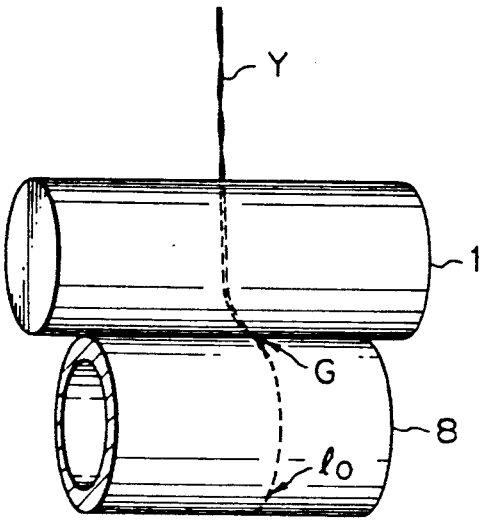
FIG. 8(A) to FIG. 8(C) are perspective views illustrating various states in which the elastic yarn is held on the empty-bobbin by the friction roll, respectively.
Figure 8B:
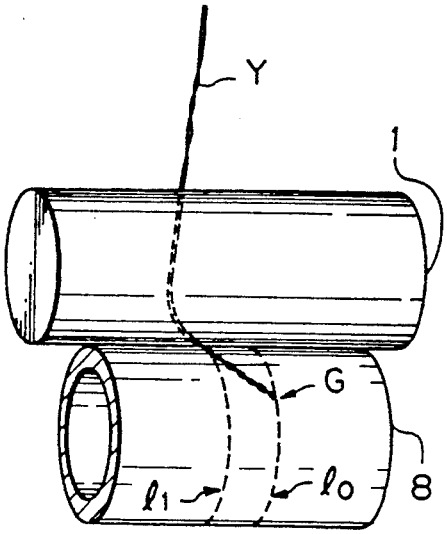
Figure 8C:
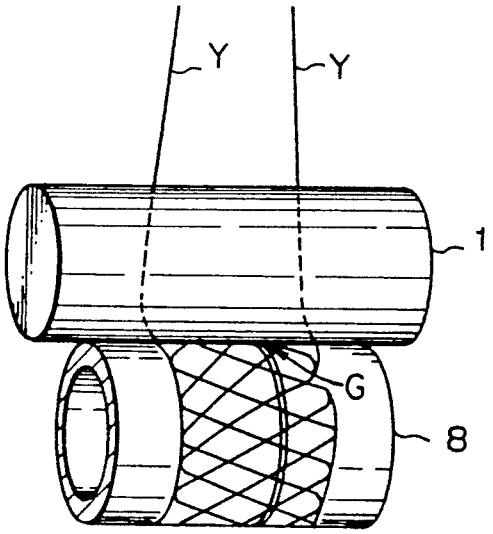

FIGS. 8(A) to 8(C) illustrate several attitudes of winding the elastic yarn on the empty-bobbin 8. Since the yarn transfer operation in accordance with the present invention is performed without a traverse motion, several turns of the elastic yarn Y wound at a point G on the empty-bobbin are kept on the same locus $l_0$ on the empty-bobbin 8 and then the friction roll 1 is brought into contact with the empty-bobbin 8, as shown in FIG. 8(A). Further, since a yarn transfer operation in a conventional winder is performed with a traverse motion, an elastic yarn Y wound at a point G in a locus $l_0$ on an empty-bobbin 8 is next wound on another locus $l_1$. Therefore the winding layer of the elastic yarn becomes loose and thus the elastic yarn wound on the empty-bobbin 8 may be transferred to the friction roll 1 as shown in FIG. 8(B). Further, after the yarn transfer operation in accordance with the present invention is performed, the normal winding with a traverse motion is applied on the winding layer of the several turns of the elastic yarn on substantially the same locus, as shown in FIG. 8(C). Therefore the winding layer caused by the yarn transfer operation can be firmly held on the empty-bobbin 8 by a normal winding with a traverse motion.

When the yarn transfer operation in accordance with the present invention is performed, it is necessary to rotate the empty-bobbin 8, and thus the empty-bobbin 8 is rotated by a motor 33. The rotation of the empty-bobbin 8 by the motor 33 is preferably at the same surface speed of the empty-bobbin 8 as that of the friction roll 1 by 50 turns to 1000 turns after the friction roll 1 is in contact with the empty-bobbin 8. If the drive of the empty-bobbin 8 is stopped after the friction roll 1 comes into contact with the empty-bobbin, a surface speed of the empty-bobbin may decrease, resulting in a transfer of the elastic yarn from the empty-bobbin 8 to the friction roll 1. Therefore, a failure of the yarn transferring operation can be avoided by rotating the empty-bobbin 8 at least 50 turns after the friction roll 1 comes into contact with the empty-bobbin 8.

As described above, preferably saw-tooth-like depressions, more precisely V-shape depressions, are provided on a top end of the yarn restricting plate 7. Namely, when the yarn restricting plate 7 is raised about the pin 41, the elastic yarn in contact with the depression is smoothly guided onto an inclined side face of the saw-tooth like depression and reaches a deepest point thereof, i.e., an apex 7*a*. Therefore, it is possible to smoothly release the elastic yarn from the traverse device 3 without applying an irregular tension to the elastic yarn, which ensures a good quality of the full-bobbin 8*a*.

Figure 9:
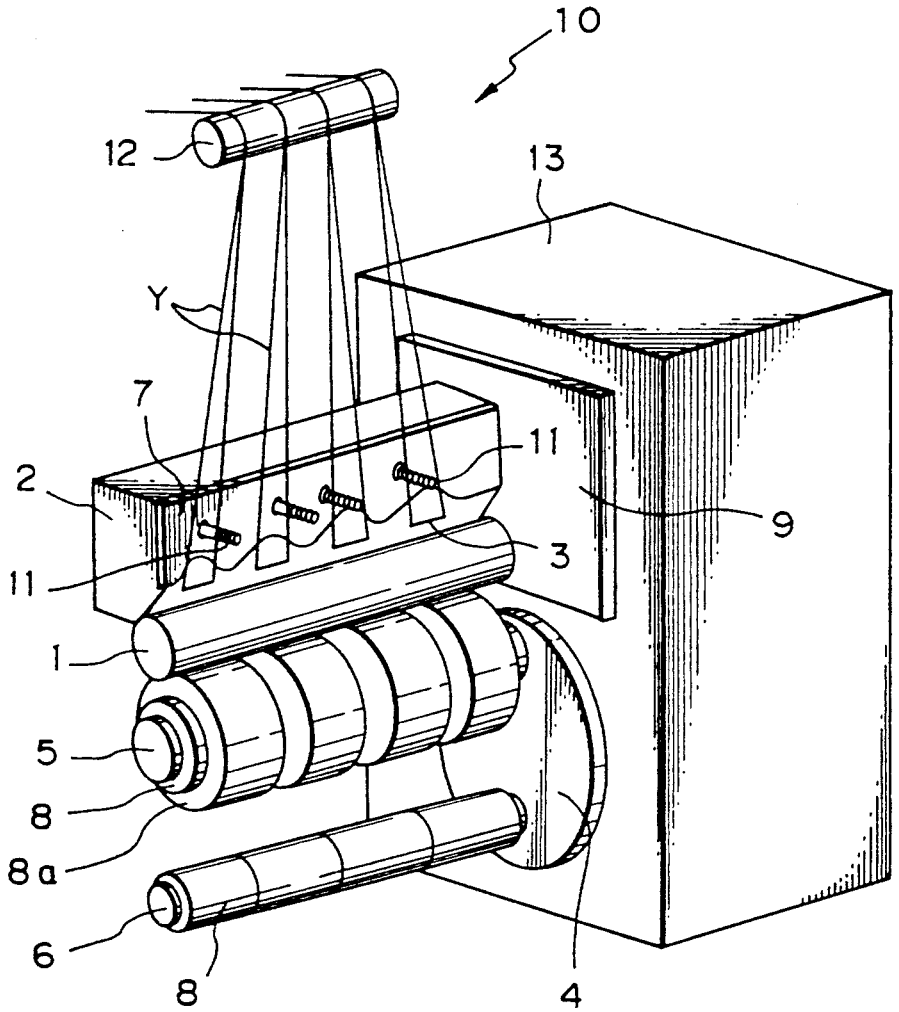
FIG. 9 is a perspective view illustrating another example of a turret type winder used for implementing an elastic yarn transfer method is accordance with the present invention.

Referring to FIGS., 7(F), 7(G), and 9, when the elastic yarn has been transferred to the empty bobbin 8, the elastic yarn is brought close to traverse device 3 by retracting yarn position restricting plate 7. Since traverse device 3 is still moving, the yarn may sometimes disengage from its respective traverse device 3 due to the fact that there may exist excessive slack in the elastic yarn. Thus, the yarn may fail to engage with the corresponding traverse device 3, resulting in a failure of the yarn transfer operation. To prevent this, separating rods 11, as shown in FIG. 9, may be provided between adjacent winding sections. Separating rods 11 may be retractably housed in traverse box 2 so as not to interface with the traverse movement of the yarn during winding onto the bobbin. When the elastic yarn is initially brought close to traverse device 3, separating rods 11 project out of the traverse box 2 so that they are located between the adjacent winding sections to prevent the yarn from becoming misaligned with its corresponding traverse device.

The automatic yarn transfer operation in accordance with the present invention will be now compared with the conventional automatic yarn transfer operation.

A polyurethane prepolymer is made from a 4,4' diphenylmethane diisocyanate and a polytetramethyleneglycol by a conventional method, and a material polymerized from the polyurethane prepolymer by a coupler such as an ethylene diamine or the like is dissolved in an solvent to make a polyurethane stock solution having a content of 27%, and a polyurethane elastic yarn of 20d or 40d is manufactured from the polyurethane stock solution by a dry spinning method.

In Example 1 the yarn has a denier of 20d, in Example 2 a denier of 40d, and comparative Examples 1 and 2 corresponding to Example 1 and Comparative Examples 3 and 4 corresponding to Example 2 are manufactured under the conditions shown in the following Table 1. The results of the effectiveness of the automatic yarn transfer operations are also shown in Table 1.

TABLE 1

| | Example 1 | Comparative Example 1 | Comparative Example 2 | Example 2 | Comparative Example 3 | Comparative Example 4 |
|---|---|---|---|---|---|---|
| Denier (d) | 20 | 20 | 20 | 40 | 40 | 40 |
| Spinning speed (m/min) | more than 600 | more than 600 | more than 600 | less than 500 | less than 500 | less than 500 |
| Number of yarns supplied to one | 4 | 4 | 4 | 4 | 4 | 4 |

TABLE 1-continued

| | Example 1 | Comparative Example 1 | Comparative Example 2 | Example 2 | Comparative Example 3 | Comparative Example 4 |
|---|---|---|---|---|---|---|
| winder | | | | | | |
| Relationship between friction roll and empty bobbin | spaced (58 mm) | contact | contact | spaced (58 mm) | contact | contact |
| Yarn position restricting plate | use | no | use | use | no | use |
| Yarn attachment from full-bobbin to empty-bobbin | stop of full-bobbin | stop of full-bobbin | yarn is cut by bobbin having a slit | stop of full-bobbin | stop of full-bobbin | yarn is cut by bobbin having a slit |
| Separating rod | use | no | no | use | no | no |
| Effectiveness | 100 | 68 | 92 | 100 | 84 | 99 |

As can be seen from Table 1, even if an elastic yarn having the denier of 20d is manufactured at a spinning speed of more than 600 m/min, it is possible to perform the yarn transfer operation without failure, i.e., with an effectiveness of 100%, by the yarn transfer method in accordance with the present invention.

We claim:

1. A method for automatically transferring an elastic yarn from a full bobbin to an empty bobbin on a yarn winding device, the yarn winding device having a movable bobbin carrier, first and second bobbin shafts rotatably mounted to the bobbin carrier for carrying respective ones of the full and empty bobbins, a friction roll connected to a driving source, the friction roll being vertically movable, and a traverse device for obtaining a traverse movement of the yarn as it is wound on the bobbin, comprising the steps of:

(a) engaging the friction roll with a bobbin on the first bobbin shaft to wind the yarn onto the bobbin;

(b) traversing the yarn with the traverse device wile the yarn is wound onto the bobbin;

(c) rotating the empty bobbin on the second bobbin shaft at substantially the same speed as that of the friction roll when a full bobbin is obtained on the first shaft;

(d) moving the friction roll upwardly so that a gap is created between the friction roll and the full bobbin;

(e) maintaining rotation of the full bobbin at a speed substantially the same as that of the friction roll;

(f) moving the bobbin carrier to reverse the positions of the full bobbin and the empty bobbin relative to the friction roll and to contact the empty bobbin with that portion of the yarn extending between the friction roll and the full bobbin;

(g) disengaging the yarn from the traverse device;

(h) rapidly stopping rotation of the full bobbin so that the yarn is broken;

(i) engaging the broken end of the yarn to the empty bobbin to begin winding of the yarn onto the empty bobbin;

(j) engaging the yarn with the traverse device; and (k) moving the friction roll into contact with the empty bobbin.

2. The method according to claim 1, wherein the bobbin carrier is a rotatable turret type, and the step of moving the bobbin carrier includes the substep of rotating the turret type bobbin carrier to reverse the positions of the empty and full bobbins.

3. The method according to claim 1, wherein the step of moving the bobbin carrier includes the substep of contacting the empty bobbin with the yarn while maintaining a distance between the empty bobbin and the friction roll of at least about 5 mm.

4. The method according to claim 1, wherein the step of disengaging the yarn from the traverse device includes the substeps of engaging the yarn with a yarn position restricting plate having a concave shape, and moving the yarn position restricting plate to displace the yarn away from the traverse device.

5. The method according to claim 1, wherein the step of moving the friction roll into contact with the empty bobbin includes the substep of continuing independent rotation of the empty bobbin until the elastic yarn is wound 50 to 1,000 turns onto the empty bobbin.

* * * * *